United States Patent [19]

Youakim

[11] Patent Number: 4,488,471

[45] Date of Patent: Dec. 18, 1984

[54] HIGH-HAT CYMBAL STAND AND METHOD OF SETTING UP THE SAME

[76] Inventor: Phillip M. Youakim, 122 Dexter St., Tonawanda, N.Y. 14150

[21] Appl. No.: 496,204

[22] Filed: May 19, 1983

[51] Int. Cl.[3] ..... G10D 13/00

[52] U.S. Cl. ..... 84/422 R; 84/422 S; 248/188.2; 248/158

[58] Field of Search ..... 84/422 C, 422 H, 422 R, 84/411, 402; 248/158, 188.2, 188.5

[56] References Cited

U.S. PATENT DOCUMENTS

| | | | |
|---|---|---|---|
| 3,299,765 | 1/1967 | Rochon | 84/422 H |
| 3,464,305 | 9/1969 | Meazzi et al. | 84/422 H |
| 3,530,757 | 9/1970 | Osuga | 84/422 H |

*Primary Examiner*—L. T. Hix
*Assistant Examiner*—Douglas S. Lee
*Attorney, Agent, or Firm*—Christel, Bean & Linihan

[57] ABSTRACT

A high-hat cymbal stand of the type including a support pipe, a foldable leg assembly having a plurality of legs and a coupler which is mounted for movement along the support pipe and to which each of the legs are attached, a set screw for releasably locking the coupler to the pipe, and a pedal assembly having a weight-supporting member which shares the weight of the stand with the legs when the stand is set up for play utilizes a spring operatively connected between the support pipe and the leg assembly which when the stand is placed upright upon a floor or similar supporting surface holds the weight-supporting member of the pedal assembly in spaced relationship to the floor. An associated method of setting up the stand distributes the weight of the stand between the pedal assembly and the legs so that the stand does not wobble or creep across the floor during play.

15 Claims, 8 Drawing Figures

HIGH-HAT CYMBAL STAND AND METHOD OF SETTING UP THE SAME

BACKGROUND OF THE INVENTION

This invention relates, generally, to the field of musical instruments and, more particularly, is concerned with a high-hat cymbal stand.

A high-hat cymbal stand, also known as a sock stand, supports two cymbals in a cup-to-cup arrangement and includes a footboard or pedal for causing the cymbals to strike one another. Such a stand, as is shown and described in U.S. Pat. No. 3,530,757, typically includes a support pipe, a leg assembly for supporting the pipe in a generally perpendicular orientation relative to a floor or similar supporting surface, and a pedal assembly. The leg assembly includes a plurality of legs and a coupler to which each of the legs is connected. The coupler is attached about the support pipe so that the support pipe and the coupler are slidably movable relative to one another. The stand also includes locking means for releasably locking the support pipe and coupler together.

The pedal assembly is attached to one end of the support pipe and includes a weight-supporting member which is adapted to rest against the floor and share the weight of the stand with the legs when the stand is set up for play. The weight-supporting member is connected to the support pipe in such a manner that it moves with the pipe as the pipe is moved relative to the coupler of the leg assembly. Therefore, when the stand is placed upright upon a floor and the support pipe is moved up or down relative to the coupler while the legs are maintained in engagement with the floor, the weight-supporting member of the pedal assembly moves away from or toward the floor.

To prevent the stand from wobbling or creeping across the floor during play, the stand must carefully be set up so that the weight of the stand is stably distributed between the legs and the weight-supporting member of the pedal assembly. If there is too much weight upon the pedal assembly as compared to the weight upon the legs, the stand will wobble during play, and if there is too much weight upon the legs as compared to the weight upon the pedal assembly, the stand will creep across the floor during play.

The stand weight is distributed, either stably or unstably, between the legs and the pedal assembly when the weight-supporting member of the pedal assembly and the legs are in engagement with the floor and the coupler of the leg assembly is locked at a selected location along the length of the support pipe. To readjust the stand to redistribute its weight between the legs and the pedal assembly, the coupler is relocated and locked at another location along the length of the support pipe. Due to differences, such as evenness and hardness, between floor surfaces, the location of the coupler along the length of the support pipe at which the stand weight is stably distributed is not necessarily the same when the stand is moved from one floor surface to another. Therefore, each time that the stand is set up, care must be taken when positioning the coupler along the support pipe.

The present method of setting up such a stand includes a trail and error procedure by which the stand weight is stably distributed between the legs and the pedal assembly. The stand is initially placed upright upon the floor so that the legs and the pedal assembly are in engagement with the floor. The support pipe is then grasped with one hand and the coupler is grasped with the other hand and the coupler and support pipe are moved relative to one another. The coupler and support pipe are subsequently locked together with the locking means while the coupler is held at a selected position along the length of the support pipe. The user then tests the stand for stability, or the possibility that the stand will wobble or creep during play, by stepping upon the pedal a number of times and jostling the stand. If a determination is made that the stand is sufficiently stable, no readjustment or redistribution of the stand weight is necessary. If, on the other hand, a determination is made that the stand will wobble or creep, the coupler is relocated and locked at another position along the length of the pipe. The stand continues to be tested for stability and readjusted until the stand is determined to be sufficiently stable for play. A disadvantage associated with the aforedescribed method of set up is that the method is quite time-consuming if several readjustments are necessary before the stand is determined to be sufficiently stable for play.

Another disadvantage associated with such an aforedescribed prior art stand relates to readjustment of the stand, or a redistribution of the stand weight, during play or a performance. Such a readjustment may be desired if the stand creeps or wobbles during play. However, since two hands are generally required to reposition the coupler along the length of the support pipe, readjustment of the stand during play can be extremely difficult, if not impossible.

Accordingly, it is an object of the present invention to provide an improved high-hat stand which can be set up much more easily and readily than a prior art stand of the type with which this invention is concerned and a method of setting up the stand.

Another object of the invention is to provide such a stand and method which obviates trial and error adjustments to achieve a stable weight distribution between the legs and the pedal assembly of the stand so that the stand does not wobble or creep during play.

Still another object of the present invention is to provide such a stand which does not require two hands for distribution of the stand weight during set up or redistribution of the stand weight following set up.

SUMMARY OF THE INVENTION

The present invention relates to a high-hat cymbal stand and a method of setting up the stand. The stand includes a support pipe assembly adapted at one end to support a first cymbal and a leg assembly at the other end thereof for supporting the pipe assembly in a perpendicular orientation to a floor or similar support surface. The leg assembly includes a plurality of legs and a coupler to which each leg is connected. The coupler is attached to the support pipe assembly to permit sliding movement of the coupler relative to and along the length of the pipe assembly, and means for releasably locking the coupler to the pipe assembly are provided in the stand. The stand also includes a pedal assembly having a weight-supporting member for engaging the floor and for supporting at least a portion of the weight of the stand when the stand is set up. The weight-supporting member is connected to the support pipe for movement therewith as the pipe is moved relative to the coupler. Biasing means are included in the stand for imposing a force between the leg assembly and the support pipe so that when the stand is placed upright upon a floor and the support pipe and coupler are permitted to move relative to one another, the biasing means holds the weight-supporting member in spaced relationship with the floor.

The method includes the steps involved in setting up of the stand of the present invention. The stand, with its coupler and support pipe permitted to move relative to one another, is initially placed upright upon a floor so that the biasing means of the stand support the weight-supporting member of the pedal assembly in spaced relationship to the floor. The weight-supporting member is then pressed firmly against the floor and the coupler and support pipe are locked together. The stand weight is thereby distributed between the legs and the pedal assembly so that the stand does not wobble or creep during play.

DETAILED DESCRIPTION OF THE PREFERRED EMBODIMENTS

Figure 1:
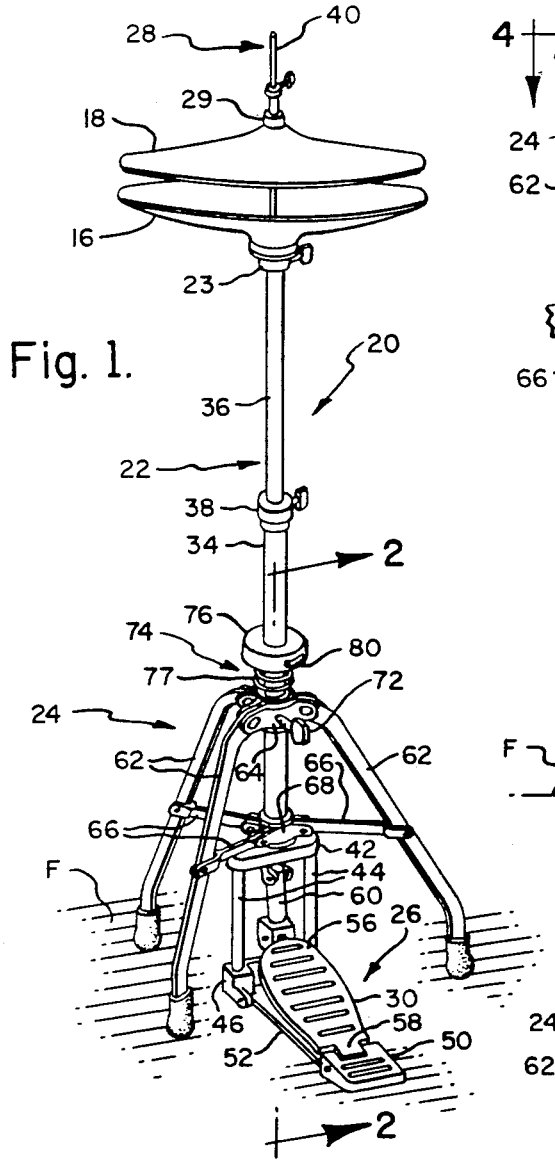
FIG. 1 is a perspective view of a high-hat cymbal stand comprising one embodiment of the present invention.

Referring now to the drawings in greater detail, there is shown in FIG. 1 a high-hat cymbal stand, generally indicated 20, in accordance with the present invention. The stand 20 supports two cymbals 16,18 and is set up for play upon a substantially horizontal floor F. Included in the stand 20 is a hollow support pipe assembly 22, a foldable leg assembly 24 and a pedal assembly 26. The support pipe assembly 22 is supported by the leg assembly 24 in a substantially perpendicular orientation relative to the floor F and is adapted at its upper end 23 to hold one, or the lower, cymbal 16 in a stationary position.

Received through the hollow support pipe assembly 22 is a rod assembly 28 including a clutch 29 near its upper end from which the other, or the upper, cymbal 18 is supported. The rod asssembly 28 is mounted within the support pipe assembly for lengthwise movement relative thereto between a lower position at which the cymbals 16 and 18 are in engagement and an upper position at which the cymbals are spaced from one another. A spring (not shown) is mounted internally of the support pipe assembly 22 in a manner well known in the art to bias the rod assembly 28 to its upper position.

The pedal assembly 26 includes a footboard or pedal 30 which is operatively connected to the lower end of the rod assembly 28. When the pedal 30 is pressed downwardly, the upper cymbal 18 moves into engagement with the lower cymbal 16, and when the pedal 30 is released, the upper cymbal 18 returns, by means of the internally mounted spring, to a position spaced above the lower cymbal 16, as shown.

The support pipe assembly 22 includes a lower support pipe 34 and an upper support pipe 36 coupled end-to-end by means of a connector 38. The rod assembly 28 includes an upper rod 40 and a lower rod 41 (shown in FIG. 2) coupled end-to-end in the vicinity of the connector 38. Because the support pipe assembly and rod assembly are each comprised of easily connectible components, the stand 20 can be readily assembled for play and easily disassembled for carrying or storage.

Figure 2:
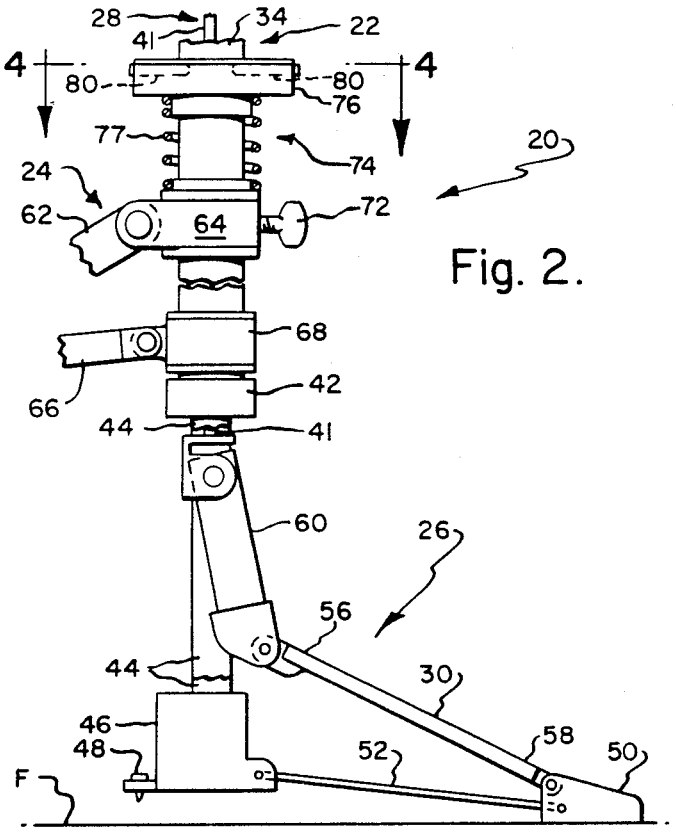
FIG. 2 is a fragmentary elevational view, partly in section, of a portion of the FIG. 1 stand drawn to a slightly larger scale and showing the base member of the pedal assembly being spaced from the floor.
Figure 3:
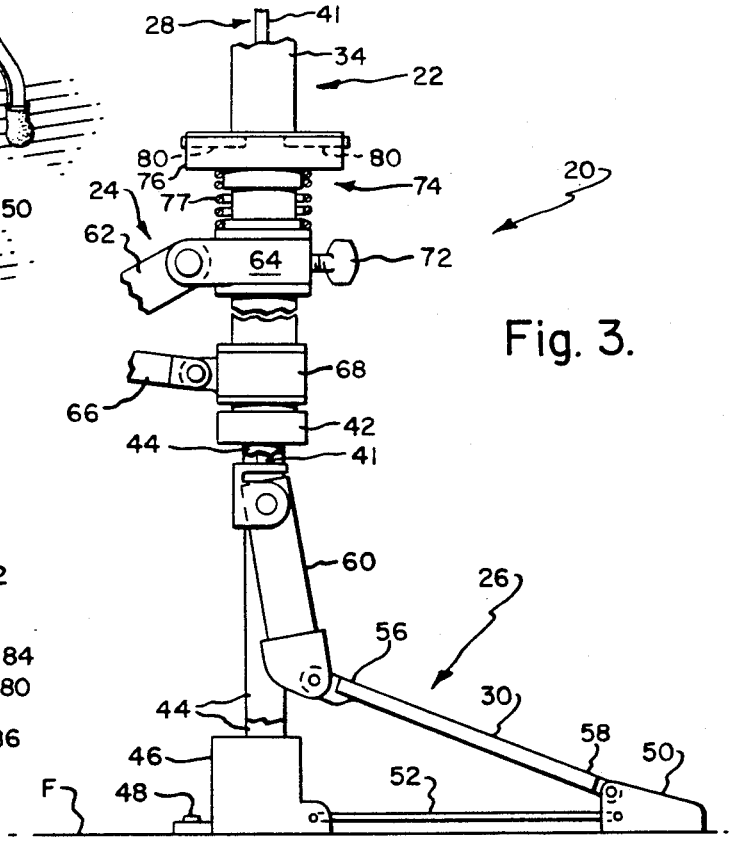
FIG. 3 is a view similar to FIG. 2 illustrating the base member of the pedal assembly being in engagement with the floor.

With reference to FIGS. 1 and 2, the pedal assembly 26 includes a pedal 30, mentioned above, and a brace arrangement having a yoke-like member 42, two elongated rods 44,44 and a base member 46. The yoke-like member 42 defines a central opening through which the lower support pipe 34 is received and is fixedly connected thereto at the lower end portion of the pipe 34 so that its opposite ends extend laterally from the pipe 34. The elongated rods 44,44 are arranged generally parallel to one another and each is connected at one end to the yoke-like member 42 and are connected at the other end to the base member 46.

The base member 46 engages the floor F when the stand is set up and includes a floor-engaging anti-skid spike 48 to help prevent the stand from creeping across the floor during play. A heel rest 50, also included in the pedal assembly 26, is joined to the base member 46 by means of two brace rods 52 (only one shown). The brace rods 52 are each pivotally connected at one of its ends to the heel rest 50 and at its other end to the base member 46. The pivotal connections of the brace rods permit the pedal assembly to be folded for storage.

The pedal 30 of the pedal assembly 26 includes a front end 56 and a back end 58 to which the heel rest 50 is pivotally connected. The front end 56 of the pedal 30 is connected to the lower end of the rod assembly 28 by means of an elongated connecting element 60. The connecting element 60 is pivotally connected at its upper end to the lower end of the rod assembly 28 and is pivotally connected at its lower end to the front end 56 of the pedal 30. Each of the aforedescribed pivotal connections of the connecting element 60 and the pedal 30 permit pivotal movement of the connected parts relative to one another about parallel axes, and when the stand 20 is set up as shown, the parallel axes are substantially horizontal. It will be understood from the above, that when the base member 46 and heel rest 50 are in engagement with the floor F and the front end 56 of the pedal 30 is reciprocated, the rod assembly 28 is reciprocated, by means of the connecting element 60, within the support pipe assembly 22.

The leg assembly 24 includes three legs 62,62 and a coupler 64 mounted about the lower support pipe 34. With reference to FIG. 1, the upper end of each leg 62 is pivotally attached to the coupler 64 by means of a pivot pin, and the lower end of each leg 62 is adapted to engage the floor F. The legs 62,62 are further secured to the support pipe 34 by means of linkages 66,66 and a collar member 68. The collar member 68 is fixed to the lower end of the support pipe 34 at a location along its length slightly above the yoke-like member 42. Each linkage 66 is pivotally connected at one end to the collar member 68 and is pivotally connected at its other end to a corresponding leg 62. Since the collar member 68 is fixed to the pipe 34, it follows that the leg assembly 24 is prevented from rotating about the pipe 34.

The coupler 64 is mounted about the support pipe 34 for sliding movement relative to and along the length of the support pipe 34. When the coupler 64 is moved from a position as shown in FIG. 1 upwardly along and relative to the support pipe 34, the lower end of the legs 62,62 move radially inwardly from a spread condition as shown toward one another. Movement of the coupler 64 to an uppermost limit of movement of the support pipe 34 moves the legs 62,62 into a folded condition against the pipe 34 at which the longitudinal axis of the pipe 34 and the legs 62,62 are generally parallel to one another. Movement of the coupler 64 downwardly along the support pipe 34 from its uppermost limit moves the legs 62,62 from the folded condition toward their FIG. 1 spread condition.

The stand 20 includes locking means for releasably locking the coupler 64 to the support pipe 34 at a selected position along the length of the pipe 34. The locking means includes a set screw 72 threadably received in an internally threaded bore in a side of the coupler 64. The shank end of the set screw 72 is movable into or out of engagement with the support pipe 34 as the set screw is tightened or loosened. Therefore, when the set screw 72 is loosened, the coupler and pipe are permitted to slidably move relative to one another, and when the set screw is tightened, the support pipe 34 is tightly clamped between the shank end of the set screw and a diametrically opposed portion of the coupler 64. The head end of the set screw 72 is in the shape of a tab so that the set screw can be tightened or loosened with the fingers.

Figure 4:
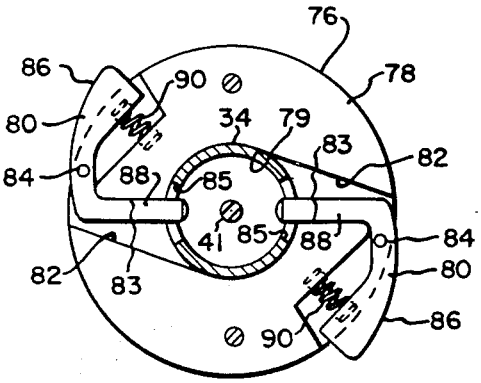
FIG. 4 is a cross-sectional view taken about on line 4—4 of FIG. 2.

In accordance with the present invention and with reference to FIG. 2, the stand 20 includes biasing means, indicated generally 74, for acting between the support pipe assembly 22 and the leg assembly 24 so that when the legs 62,62 are in their FIG. 1 spread condition and the set screw 72 is loosened, the base member 46 of the pedal assembly 26 is spaced above the floor F as shown. The biasing means 74 includes a ring clamp 76 and a compression spring 77. The ring clamp 76, as best shown in FIG. 4, includes a ring 78 having through bore 79 through which the support pipe 34 is loosely received and a pair of locking levers 80,80. Each locking lever 80 is L-shaped and is mounted within one of two defined recesses 82,82 in the upper surface of the ring 78. One leg 86 of each lever 80 is pivotally attached by means of a screw 84 to the ring 78, and the other leg 88 of each lever 80 is arranged generally perpendicular to the support pipe 34. Two compression springs 90,90, each having its opposite ends fixedly embedded within a corresponding lever leg 86 and a side of a recess 82, act between the ring 78 and the levers 80,80 to bias the lever legs 88,88 toward and into engagement with the sides, indicated 83,83, of the recesses 82,82. The free end of each lever leg 88 is received in a corresponding one of two slots 85,85 defined in the side of the support pipe 34 when the lever leg 88 engages the recess side 83, as shown in FIG. 4, to thereby lock the ring clamp 76 to the support pipe 34. The free end of each lever leg 88 is withdrawn from its corresponding slot 85 to thereby unlock the ring clamp 76 and support pipe 34, for a reason hereinafter set forth, as the free ends of the lever legs 86,86 are manually pressed radially inwardly of the ring 78.

The compression spring 77 of the biasing means 74 is loosely received about the support pipe 34 and is connected at one of its ends to the ring 78 and is connected at its other end to the coupler 64 so that the compression forces of the spring 77 act between the lower face of the ring 78 and the upper face of the coupler 64 and so that neither the spring 77 nor the ring 78 is permitted to rotate about the pipe 34.

In FIG. 2, the stand 20 is set upright upon the floor F, the legs 62,62 are in their spread condition, and the coupler 64 is not locked to the support pipe 34. Under these circumstances, the compression spring 77 of the biasing means 74 supports the base member 46 of the pedal assembly 26 in spaced relationship with the floor F. It will be understood that when the legs 62,62 are in their spread condition, gravitational forces which would otherwise pull the base member 46 of the pedal assembly 26 toward the floor F, are counteracted by the biasing means 74. Therefore, the biasing means 74 holds the base member 46 in an elevated condition in opposition to the forces of gravity.

To set up the stand 20, the stand is initially set upright upon the floor F in the aforedescribed FIG. 2 condition so that the biasing means 74 supports the base member 46 above the floor F. Downward pressure is then applied to the base member 46 so that the support pipe assembly 22 moves downwardly relative to the coupler 64 and the spring 77 is compressed until the base member 46 is pressed into firm engagement with the floor F. Then, while the base member 46 is pressed against the floor F, the set screw 72 within the coupler 64 is tightened to lock the coupler 64 and the support pipe assembly 22 together. The weight of the stand 20 is thereby stably distributed between the legs 62,62 and the base member 46 so that the stand 20 does not wobble or creep across the floor F during play. Time consuming trial and error adjustments of the stand to stably distribute the stand weight are thereby obviated. It will be understood that the spring 77 is of such size and strength that the base member 46 can be pressed to the floor from its FIG. 2 elevated condition within the elastic limit of the spring 77.

To press the base member 46 to the floor F, the pedal 30 can be simply stepped upon. Downward movement of the front end 56 of the pedal 30 first brings the upper cymbal 18 downwardly into engagement with the lower cymbal 16 and then, by means of the engaged cymbals, forces the support pipe assembly 22 downwardly with respect to the coupler 64. To tighten the set screw 72, one hand can be used. It follows from the above that two hands are not required to stably distribute the stand weight between the legs and pedal assembly during set up and that therefore if a user desires to readjust or redistribute the stand weight during play, he can make such an adjustment with little or no interruption in his performance because one of his hands is free to play.

To take down the stand 20 from its set up condition, the set screw 72 is loosened to unlock the coupler 64 and support pipe assembly 22 and the legs 86,86 of the locking levers 80,80 are pressed so that the free end of the lever legs 88,88 move out of the support pipe holes 85,85. While the locking levers are held out of the support pipe holes, the ring clamp 76, spring 77 and coupler 64 are moved upwardly along the support pipe 34 to move the legs 62,62 into their folded condition. To return the stand to its FIG. 2 condition from its folded condition, the lower ends of the legs 62,62 are moved radially outwardly from one another so that the coupler 64 and ring clamp 76 move down the support pipe 34, and until the locking levers 80,80 snap within the corresponding holes 85,85 in the support pipe 34. It will be understood from the above that the holes 85,85 of the support pipe 34 are so located along the length thereof so that the biasing means 74 holds the base member 46 in its FIG. 2 elevated condition when the stand 20 is initially set upright. Therefore, the stand 20 can be easily and readily set up from a condition at which the legs 62,62 are folded together.

Figure 5:
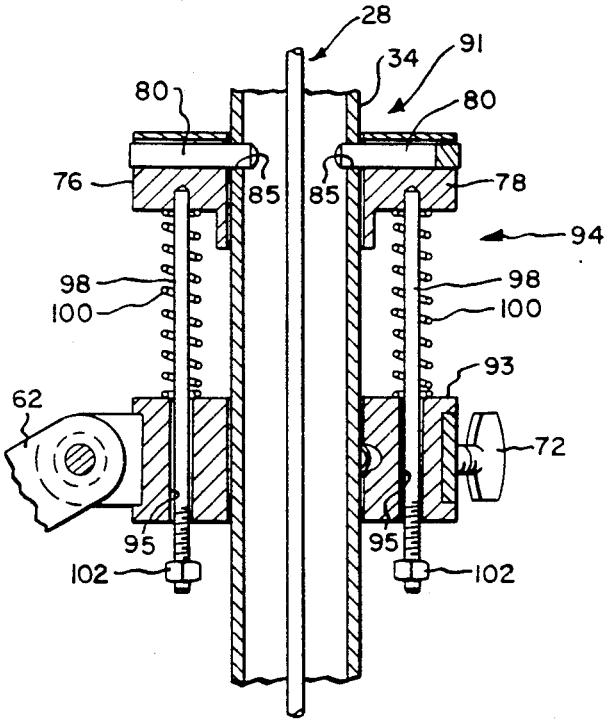
FIG. 5 is a fragmentary elevational view, partly in section, of a portion of a high-hat stand comprising another embodiment of the present invention.

FIG. 5 illustrates another embodiment of a high-hat cymbal stand, indicated 91, in accordance with the present invention. The same reference numbers are used for previously defined elements. In this embodiment, the coupler to which the legs 62,62 are attached is indicated 93 and the biasing means for acting between the stand support pipe assembly and the leg assembly is indicated generally 94. The coupler 93 defines a plurality of through bores 95,95 as shown for a reason hereinafter apparent. The biasing means 94 includes a ring clamp 76 and a plurality of push rods 98,98 and compression springs 100,100. A portion of each push rod 98 is loosely received within a corresponding bore 95 of the coupler 93. One end, or the upper end, of each push rod 98 is embedded within and fixedly attached to the ring clamp 76, and a nut 102 is fixed to the other end, or lower end of each push rod 98. Each nut 102 is of greater diameter than the diameter of the corresponding through bore 95 of the coupler 93 so that the coupler 93 is thereby retained upon the push rods 98,98 between the nuts 102,102 and the ring clamp 76.

The springs 100,100 act between the lower face of the ring clamp 76 and the upper face of the coupler 93. The springs 100,100 are of sufficient collective strength so that when the stand is placed upright with its legs in a spread condition and the coupler 93 is permitted to move relative to the support pipe 34, the base member 46 of the pedal assembly is spaced from the floor. To complete the set up of the stand 91 when it is initially placed upright upon the floor in such a condition, the base member of the pedal assembly is pressed to the floor while the support pipe 34 moves downwardly relative to the coupler 93 and the springs 100,100 compress. Then, with the base member pressed in engagement with the floor, the set screw 72 supported within the coupler 93 is tightened to lock the coupler 93 to the support pipe 34. The stand 91 is taken down from its set up condition in a manner identical to the manner, set out above, in which the stand 20 of FIGS. 1–4 is taken down.

Figure 6:
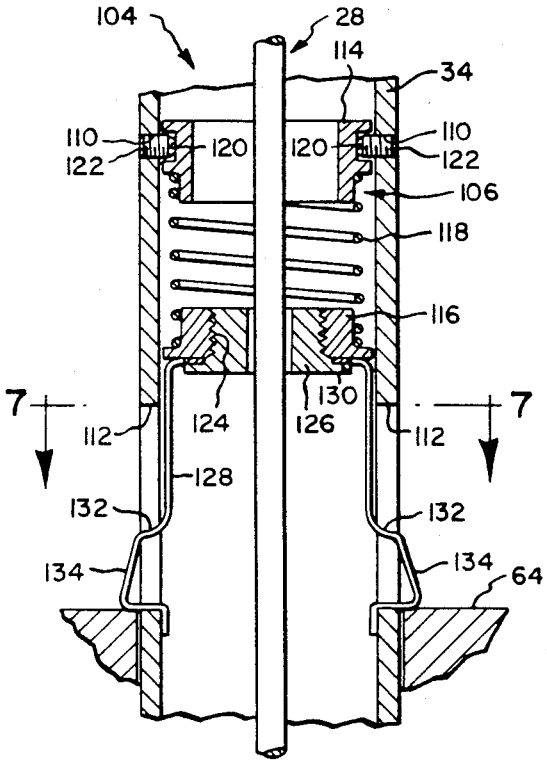
FIG. 6 is a fragmentary elevational view, partly in section, of a portion of a high-hat stand comprising still another embodiment of the present invention.

FIG. 6 illustrates still another embodiment of a high-hat stand, indicated 104, in accordance with the present invention. The same reference numbers are used for previously defined elements. The stand 104 includes biasing means, generally indicated 106, comprised of a spring arrangement mounted internally of the support pipe 34. The support pipe 34 defines two internally threaded holes 110,110 and two vertically elongated slots 112,112 for a reason hereinafter apparent. The biasing means 106 includes an upper spring rest 114, a lower spring rest 116 and a compression spring 118 fixed at its upper end to the upper spring rest 114 and fixed at its lower end to the lower spring rest 116. The upper spring rest 114 defines a central through bore through which the rod assembly 28 is loosely received and two recesses 120,120. Two set screws 122,122 are each tightened within a hole 110 of the support pipe 34 and against the base of a corresponding recess 120 of the upper spring rest 114 to hold the spring rest 114 securely in place.

Figure 7:
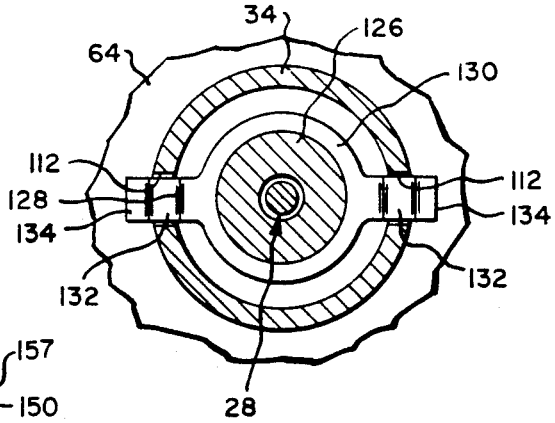
FIG. 7 is a cross-sectional view taken generally about on line 7—7 of FIG. 6.

The lower spring rest 116 defines an internally threaded bore 124 within which a threaded plug 126 is threadably received. Between the head of the plug 126 and the lower spring rest 116 is fastened a locking member 128. As best shown in FIG. 7, the locking member includes an upper ring portion 130, positioned and secured between the plug 126 and spring rest 116, and two arms 132,132 extending downwardly therefrom. The locking member 128 is constructed of a resilient material, such as steel, and is shaped as shown in FIG. 6. A portion of each arm 132 of the locking member 128 forms a tab 134 of such shape to be received within a corresponding slot 112 of the support pipe 34 and, which when received therethrough, is engageable with the upper surface of the coupler 64, as shown.

When the stand 104 is placed upright upon a floor with its legs in spread condition and the coupler 64 is permitted to move relative to and along the length of the support pipe 34, the biasing means 106 supports the base member of the stand pedal assembly in spaced relationship with the floor as the tabs 134,134 press against the upper surface of the coupler 64. To complete set up of the stand 104 when initially placed in such an upright condition, the base member of the pedal assembly is pressed to the floor while the support pipe 34 moves downwardly relative to the coupler 64 and the spring 118 compresses. Then, with the base member pressed against the floor, the set screw supported within the coupler 64 is tightened.

To take down the stand 104 from its set up condition, the set screw supported within the coupler 64 is loosened and the tabs 134 of the locking member 128 are pressed radially inwardly so that the coupler is thereby permitted to move upwardly along the support pipe and the legs of the stand are permitted to be moved into their folded condition. The coupler 64 holds the tabs 134,134 inboard of the support pipe surface while the coupler passes upwardly over the tabs and permits the tabs to spring radially outwardly to the FIG. 6 position after the coupler has passed over them.

To place the stand upright from its folded condition, the coupler 64 is initially moved, downwardly as viewed in FIG. 6, along the support pipe 34 so that the legs move from a folded condition into a spread condition. As the coupler continues to be moved downwardly, the coupler 64 engages the tabs 134,134 and presses them radially inwardly. The coupler 64 is ceased to be moved downwardly along the support pipe when it reaches a position therealong below the tabs 134,134 at which the tabs 134,134 spring radially outwardly to their FIG. 6 position.

Figure 8:
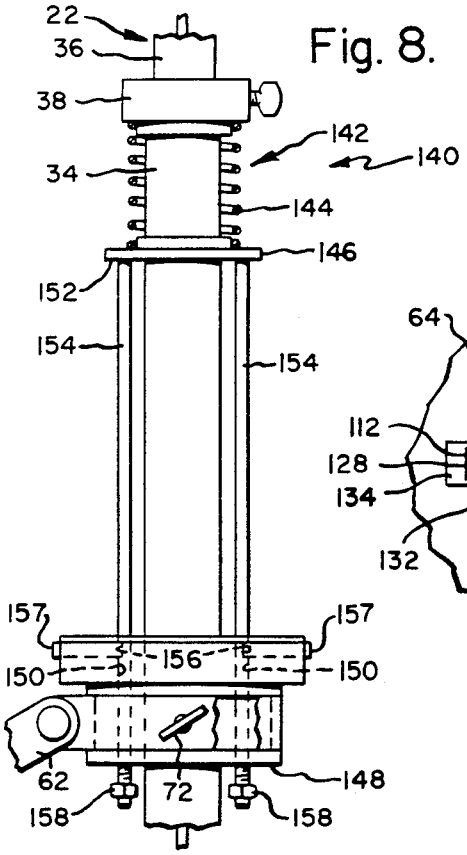
FIG. 8 is a fragmentary elevational view, partly in section, of a portion of a high-hat stand comprising yet still another embodiment of the present invention.

FIG. 8 illustrates still another embodiment of a high-hat stand, indicated 140, in accordance with the present invention. The same reference numbers are used for previously defined elements. The stand 140 includes biasing means, generally indicated 142, comprised of a compression spring 144 and push rod assembly 146. The coupler to which each leg 62 (only one shown) is connected is indicated 148 and includes two bores 150,150 as shown. The push rod assembly 146 includes a ring plate 152 and two push rods 154,154 fixed at one end to the ring plate 152 and loosely received at its other end by a corresponding bore 150 in the coupler 148. Each of the push rods 154 define a notch 156 along its length for a reason which will be hereinafter apparent, and is threaded at its lower end for retaining a threaded nut 158 thereon.

The spring 144 is fixedly attached at its upper end to the connector 38 and is fixedly attached at its lower end to the ring plate 152 so that the biasing forces of the spring act between the lower face of the connector 38 and the upper face of the ring plate 152.

The coupler 148 includes a set screw 72 for releasably locking the coupler to the support pipe assembly 22, and further includes spring-biased locking levers 157,157 which cooperate with the notches 156,156 in the push rods 154,154 to releasably lock the coupler 148 and push rods 154,154 together. Each locking lever 157 is mounted in a recess in the coupler 148 and is biased into engagement with the push rods. When the push rods 154,154 are permitted to move axially along the bores 150,150 and relative to the coupler 148 so that the locking levers 157,157 align with a corresponding notch 156 in the push rods 154,154, the levers 157,157 snap into the notches 156,156 and releasably lock the coupler 148 to the push rods 154,154. The coupler 148 can be unlocked from the push rods 154,154 by pressing the levers 157,157 radially inwardly so that the levers 157,157 withdraw from the notches 156,156.

When the stand 140 is placed upright with its legs in spread condition, the coupler 148 is permitted to move relative to the support pipe assembly 22, and the coupler 148 locked to the push rods 154,154, as shown, the base member of the pedal assembly is spaced from the floor. The stand 140 can be set up from such an upright condition by pressing the base member of the pedal assembly against the floor and then tightening the set screw 72. The stand 140 can be taken down from its set up condition by loosening the set screw 72 and pressing the locking levers 80,80 radially inwardly to permit the coupler 148 to move relative to the push rods 154,154. As the coupler 148 is moved upwardly relative to and along the length of the push rods 154,154, the legs 62 move into their folded condition. To return the stand 140 to its FIG. 8 upright condition from its folded condition the coupler 148 is simply moved downwardly relative to and along the length of the push rods until the locking levers 157,157 snap within the notches 156,156 of the push rods 154,154.

It will be understood that many modifications can be had to the aforedescribed embodiments without departing from the spirit of the invention. For example, although one end portion of the biasing means of the aforedescribed embodiments has been described and shown as being directly attached to the coupler of the stand leg assembly and the other end portion of the biasing means has been described and shown as being directly attached to the support pipe so that the biasing means act between the support pipe assembly and the leg assembly, biasing means in accordance with this invention are not necessarily so attached. With reference to the leg assembly 24 of FIG. 1, biasing means which bias its end portion toward one another can, in accordance with this invention, be attached between an upper portion of a leg 62 and a corresponding linkage 66 of the leg assembly. Biasing means attached between such leg assembly components bias the upper portion of the leg 62 and the linkage 66 together so that the support pipe assembly is biased upwardly relative to the coupler and so that the base member of the pedal assembly is supported in spaced relationship with the floor.

Furthermore, although the biasing means of the aforedescribed embodiments have been described and shown as including a compression spring, biasing means in accordance with the present invention can include other force-imposing means such as a tension spring or a sealed piston/cylinder assembly containing gas under pressure. It will be understood, however, that each of such biasing means includes two end portions between which the biasing force of the biasing means acts and is so connected between high-hat stand components that the biasing force holds the base member of the pedal assembly in spaced relationship to the floor in opposition to the forces of gravity when the stand is placed upright and the coupler and support pipe are permitted to move relative to one another. Accordingly, the aforedescribed embodiments are intended as illustration and not as limitation.

I claim:

1. In a high-hat cymbal stand including a support pipe, a leg assembly for supporting said pipe upright in a generally perpendicular orientation relative to a floor or similar supporting surface, said leg assembly including a plurality of legs and a coupler to which each leg is connected, said coupler being received about said pipe for sliding movement relative to and along the length of said pipe, means for releasably locking said coupler to said pipe at a selected position along the length of said pipe, and a pedal assembly including a weight-supporting member for engaging the floor and for supporting at least a portion of the weight of said stand when said stand is set up, said weight-supporting member being connected to said support pipe for movement therewith as said pipe is moved relative to said coupler, the improvement comprising:

biasing means for imposing a force between said leg assembly and said support pipe so that when said stand is placed upright upon a floor and said support pipe and said coupler are permitted to move relative to one another, said biasing means hold said weight-supporting member in opposition to the gravitational bias thereof and in spaced relationship with the floor.

2. The improvement of claim 1 wherein said biasing means includes two end portions between which the holding force of said biasing means acts, one of said end portions being operatively associated with said support pipe and the other of said end portions being operatively associated with said leg assembly.

3. The improvement of claim 1 wherein said biasing means includes at least one spring for imposing the holding force of said biasing means.

4. The improvement of claim 3 wherein said spring is of such size and strength so that when said stand is placed upright and said coupler and said pipe are permitted to move relative to one another, said weight-supporting member can be manually pressed against the floor from its spaced position above the floor within the elastic limit of said spring.

5. The improvement of claim 2 wherein said one end portion of said biasing means which is operatively associated with said support pipe is locked to said support pipe at a selected location therealong and said other end portion of said biasing means is in engagement with said coupler of said leg assembly.

6. A high-hat stand for supporting two cymbals, said stand comprising:

a hollow pipe assembly adapted at one end to support one cymbal;

a leg assembly for supporting said support pipe assembly in a substantially perpendicular orientation to a floor or similar support surface, said leg assembly including a plurality of legs and a coupler to which each leg is connected, said coupler being received about said support pipe assembly to permit sliding movement of said coupler relative to and along the length of said pipe assembly;

means for releasably locking said coupler and said support pipe assembly together;

a rod assembly mounted within said hollow support pipe assembly for axial movement therealong and adapted at one end to support the other cymbal;

a pedal assembly including a weight-supporting member for engaging said floor and supporting at least a portion of the weight of said stand when said stand is set up, said weight-supporting member of said pedal assembly being connected to said support pipe assembly for movement therewith as said pipe assembly and said coupler are moved relative to one another, and a pedal operatively connected to the end of said rod assembly opposite said cymbal end for operation of said cymbals; and biasing means cooperating between said leg assembly and said support pipe assembly so that when said stand is set upright and said coupler and said pipe assembly are permitted to move relative to one another, said biasing means hold said weight-supporting member of said pedal assembly in opposition to the gravitational bias thereof and in spaced relationship with the floor.

7. A high-hat stand as defined in claim 6 wherein said biasing means includes two end portions between which the holding force of said biasing means acts, one of said end portions being connected to said coupler and the other of said end portions being releasably securable to said support pipe assembly at a selected position therealong.

8. A high-hat stand as defined in claim 7 wherein said support pipe assembly defines an aperture in its side and said other end portion of said biasing means includes means cooperable with said pipe assembly aperture to releasably lock said other end portion to said support pipe assembly.

9. A high-hat stand as defined in claim 8 wherein said cooperable means of said other end portion of said biasing means includes a ring loosely received about said support pipe and a locking lever movably supported by said ring for movement into and out of said defined aperture of said support pipe assembly.

10. A high-hat stand as defined in claim 6 wherein said biasing means includes two end portions between which the holding force of said biasing means acts, one of said end portions being connected to said support pipe assembly and the other of said end portions being releasably engageable with said coupler of said leg assembly.

11. A high-hat stand as defined in claim 6 wherein said support pipe assembly defines an elongated slot extending axially along said pipe assembly and said biasing means includes a locking member and spring being mounted within said support pipe assembly, one end of said spring being fixedly secured to said pipe assembly and the other end of said spring being fixedly secured to said locking member, said locking member including a portion which is engageable with said coupler of said leg assembly through said defined elongated slot and through which the holding force of said biasing means is imposed against said leg assembly, said locking member portion being guided along said elongated slot as said other end of said spring is moved axially along said pipe assembly.

12. A high-hat stand as defined in claim 11 wherein said locking member is spring-biased radially outwardly of said pipe assembly through said elongated slot and is of such shape that said coupler is permitted to pass over said locking member portion when said coupler is moved in one axial direction along said pipe assembly but said coupler is prevented from passing over said locking member portion when said coupler is moved in the other axial direction along said pipe assembly.

13. A method of setting up a high-hat cymbal stand including a support pipe, a leg assembly for supporting said pipe upright in a generally perpendicular orientation relative to a floor or similar supporting surface, said leg assembly including a plurality of legs and a coupler to which each leg is connected, said coupler being received about said pipe for sliding movement relative to and along the length of said pipe, means for releasably locking said coupler to said pipe at a selected position along the length of said pipe, a pedal assembly including a weight-supporting member for engaging the floor and for supporting at least a portion of the weight of said stand when said stand is set up, said weight-supporting member being connected to said support pipe for movement therewith as said pipe is moved relative to said coupler, and biasing means for imposing a force between said leg assembly and said support pipe so that when said stand is placed upright upon a floor and said support pipe and said coupler are permitted to move relative to one another, said biasing means holds said weight-supporting member in opposition to the gravitational bias thereof and in spaced relationship with the floor, said method comprising:

placing said stand upright upon a floor with said coupler and said support pipe being permitted to move relative to one another;

pressing said base member of said stand into firm engagement with the floor; and locking said coupler to said support pipe while said base member is maintained in firm engagement with the floor.

14. A method as defined in claim 13 wherein the step of pressing said base member into engagement with the floor comprises stepping upon said pedal assembly.

15. A suspension mechanism for attachment to a high-hat cymbal stand including a support pipe, a leg assembly for supporting the pipe upright in a generally perpendicular orientation relative to a floor or similar supporting surface, the leg assembly including a plurality of legs and a coupler to which each leg is connected, the coupler being received about said pipe for sliding movement relative to and along the length of the pipe, means for releasably locking the coupler to the pipe at a selected position along the length of the pipe, and a pedal assembly including a weight-supporting member for engaging the floor and for supporting at least a portion of the weight of the stand when the stand is set up, the weight-supporting member being connected to the support pipe for movement therewith as the pipe is moved relative to the coupler, said suspension mechanism comprising:

biasing means for imposing a force between the leg assembly and the support pipe so that when said stand is placed upright upon a floor and the support pipe and coupler are permitted to move relative to one another, said biasing means hold the weight-supporting member in opposition to the gravitational bias thereof and in spaced relationship with the floor.

* * * * *